US007096169B2

(12) United States Patent
Crutchfield, Jr.

(10) Patent No.: US 7,096,169 B2
(45) Date of Patent: Aug. 22, 2006

(54) VIRTUAL SPEAKER DEMONSTRATION SYSTEM AND VIRTUAL NOISE SIMULATION

(75) Inventor: William G. Crutchfield, Jr., Albemarle County, VA (US)

(73) Assignee: Crutchfield Corporation, Charlottesville, VA (US)

( * ) Notice: Subject to any disclaimer, the term of this patent is extended or adjusted under 35 U.S.C. 154(b) by 856 days.

(21) Appl. No.: 10/147,476

(22) Filed: May 16, 2002

(65) Prior Publication Data

US 2003/0215097 A1 Nov. 20, 2003

(51) Int. Cl.
*G10K 11/00* (2006.01)
*H04R 29/00* (2006.01)

(52) U.S. Cl. ..... 703/7; 703/2; 381/71.1; 381/77; 381/79

(58) Field of Classification Search ..... 703/2, 703/7; 381/61, 63, 71.1, 77, 79, 300
See application file for complete search history.

(56) References Cited

U.S. PATENT DOCUMENTS

| | | | | |
|---|---|---|---|---|
| 4,217,573 | A | 8/1980 | Norris | |
| 5,479,516 | A | 12/1995 | Damato et al. | |
| 5,606,624 | A | 2/1997 | Damato | |
| 5,646,602 | A | 7/1997 | Gertz et al. | |
| 6,088,521 | A | 7/2000 | Strumolo et al. | |
| 6,353,670 | B1 | 3/2002 | Gasner | |
| 6,751,322 | B1 * | 6/2004 | Carlbom et al. | 381/63 |
| 2005/0169484 | A1 * | 8/2005 | Cascone et al. | 381/61 |

OTHER PUBLICATIONS

"EASE v3.0 for Windows". Copyright © 1999. http://www.jblpro.com/ease. Printed Oct. 25, 2005.*

Edelbrock, P. "Room Acoustics Modeling."© 1996. http://pcfarina.eng.unipr.it/Aurora/SAW/RoomSim.html.*

Christensen, C.L. "Odeon Room Acoustics Software—Publications." Copyright © 1998-2004. Last Modified Aug. 25, 2005. http://www.dat.dtu.dk/~odeon/publicat.htm.*

Rindel, J.H. "The Use of Computer Modeling in Room Acoustics." Journal of Vibroengineering. © 2000. No. 3(4). pp. 41-72.*

ETC-Electro-acoustic Testing Company. "Here is an overview of the data that we provide." http://www.etcinc.us/Data.htm. Undated. Printed on Oct. 25, 2005.*

"MATLAB Software Sounds Good to DEQX." HTML version of the PDF file found at http://www.ceanet.com.au/pdfs/DEQX.pdf. Undated. Printed Oct. 25, 2005.*

"CLF—A Common Loudspeaker File Format." vol. 32, No. 4, Fall 2004. http://www.clfgroup.org/clf_SAV_Newsletter_fall_2004.pdf.*

(Continued)

*Primary Examiner*—Paul L. Rodriguez
*Assistant Examiner*—Ayal I. Sharon
(74) *Attorney, Agent, or Firm*—Hunton & Williams LLP

(57) ABSTRACT

A virtual speaker demonstration system is disclosed that permits a retail outlet to use a reference speaker to demonstrate the performance of multiple different demonstration speakers. A user interface permits a user to select a demonstration speaker and signal processing is performed so that the output from the reference speaker simulates the output of the selected demonstration speaker. The invention provides benefits to all three of the consumer, the retailer, and the manufacturer. The consumer can listen to and compare multiple demonstration speakers easily and conveniently from the same reference speaker. The retailer to use a single (or few) reference speaker to demonstrate the performance of multiple demonstration speakers, saving costs and space. The manufacturer to be able to display and demonstrate to consumers a broader range of the manufacturer's product line.

79 Claims, 13 Drawing Sheets

OTHER PUBLICATIONS

Tsingos, N. et al. "Validating Acoustical Simulations in the Bell Labs Box." IEEE Computer Graphics and Applications. Jul./Aug. 2002, vol. 22, Issue 4, pp. 28-37.*

Savioja, L. et al. "Interactive Room Acoustic Rendering in Real Time." Proc. 2002 IEEE Int'l Conf. on Multimedia and Expo (ICME '02). Aug. 27-29, 2002, vol. 1, pp. 497-500.*

Howe, R.M. et al. "A Methodological Critique of Local Room Equalization Techniques." IEE Colloquium on Digital Audio Signal Processing. May 22, 1991.*

Kawano, S. "Development of the Virtual Sound Algorithm." IEEE Transactions on Consumer Electronics. Aug. 1998, vol. 44, Issue 3, pp. 1189-1193.*

EASE 3.0 for Windows User Manual & Tutorial, Jun. 6, 2000 Issue, version 3.0.0.64.6. © 2000.*

Link to R-H Europe, printed May 3, 2002, 121 pages, <http://www.renkus-heinz.com/About_open2.htm>.

Speaker Pro, printed May 3, 2002, 5 pages, <http://www.members.aol.com/speaker60e/speakerpro.html>.

PCT International Search Report dated Aug. 1, 2003, 7 pages.

* cited by examiner

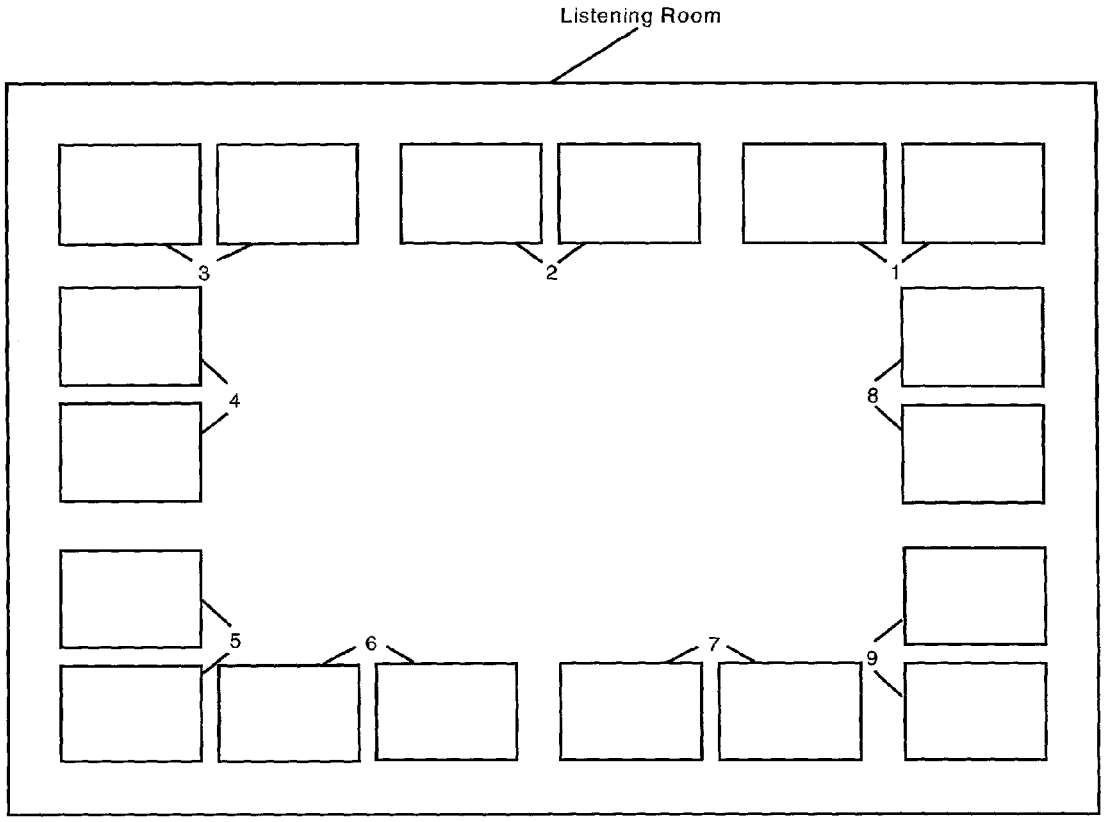
Fig. 1A - Prior Art Dedicated Listening Room

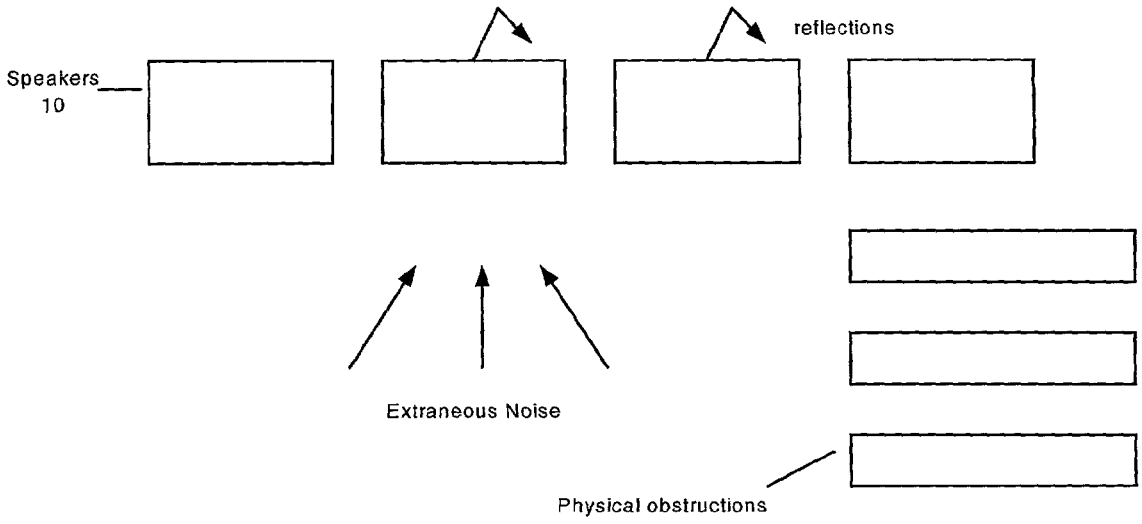
Fig. 1B Prior Art Non-dedicated Listening Room

VIRTUAL SPEAKER DEMONSTRATION SYSTEM AND VIRTUAL NOISE SIMULATION

FIELD OF THE INVENTION

The present invention relates generally acoustic measurement and simulation, and particularly, to the virtual demonstration of acoustic systems.

BACKGROUND OF THE INVENTION

Retailers of stereo equipment find it necessary to provide demonstrations of equipment so that customers can evaluate and compare products they are considering for purchase. In today's marketplace for stereo equipment, there is a plethora of options ranging from fairly low-end equipment costing in the hundreds of dollars to sophisticated high-end equipment costing in the thousands or tens of thousands of dollars.

For example, loudspeakers can cost less than $100 per pair up to thousands per pair or more. At each level, there are a variety of options provided by the typical loudspeaker manufacturer. For example, for the consumer looking for moderately high-end speakers for under $1000, there may be several products for floor speakers, several for bookshelf speakers, and so forth. Multiply these variations by the number of manufacturers carried by a well-stocked retailer and it is readily appreciated that the consumer may have to choose from among ten or more options that generally fit within the consumer's initial budget and performance requirements.

Not surprisingly then, providing the demonstrations required by consumers becomes a significant challenge for the retailer. FIG. 1A illustrates a typical prior art dedicated listening room that is crowded with a number of demonstration loudspeakers, sets 1–9. The speakers are crowded around the perimeter of the listening room in an unaesthetic and inconvenient manner.

For one thing, the number of loudspeakers that can be displayed and demonstrated is limited. The retailer may not be able to display/demonstrate all of the loudspeakers that the retailer carries, or alternatively, the retailer needs to have additional listening rooms, which is costly.

Also, a significant amount of complicated, costly, ungainly, and sometimes unreliable wiring is required to switch among loudspeaker sets 1–9. Moreover, the lengths of the wiring changes from set to set, meaning that loss characteristics are not the same for all sets. For example, if a tuner/CD player, amplifier, and switch are located adjacent loudspeaker set 1, the length of the cabling to set 5 will be much longer than to set 1. All other things being equal, there will be additional loss and noise associated with set 5 as compared to set 1.

Also, the consumer comparing the various sets has to walk from one set to the other in order to comparatively evaluate sets of loudspeakers.

Also, because the speakers are located at different positions in the room, the even-handed comparison that the consumer seeks is undermined by the different positioning of the speakers. For example, a consumer comparing set 2 to set 5 is not hearing a valid comparison because the effect of the room geometry and room material characteristics is different in the two cases.

Also, the existence of so many sets of loudspeakers in the crowded listening room in FIG. 1 biases the characteristics of the listening room unfavorably, creating undesired reflections and sound paths.

More generally, listening rooms are inherently biased in the sense that they are unrepresentative of the actual environment in which a consumer will install the equipment. For example, some retailers provide "dedicated" listening environments such as that of FIG. 1A, which is a special room set aside for speaker demonstration. High end retailers like Myer Emco™ and Tweeter™ often provide such dedicated listening rooms. While in some respects (e.g., reduced background noise) these dedicated listening rooms are an improvement over open-air non-dedicated listening rooms (discussed below), such dedicated listening rooms still suffer the significant drawback that they do not represent the actual environment the consumer will use. In short, the consumer will not hear a demonstration of what the speakers will really sound like in his/her home or office.

Other retailers simply use open-air non-dedicated listening environments, e.g., an open showroom in Best Buy™ or Circuit City™. Such non-dedicated listening environments often have poor acoustic characteristics and significant background noise. FIG. 1B illustrates a non-dedicated listening room in a department store. It can readily be appreciated that the performance of demonstration speakers 10 will be biased by the various reflections that result from the structure of the store, physical obstructions (e.g., aisles, stacks of products, cashiers, etc.), and from the significant interference created by extraneous background noise. Whether the consumer's intended environment is a home living room or the interior of a car, the conventional non-dedicated listening room will not provide the consumer with a demonstration of what the speakers will sound like in the consumer's actual environment. This is a significant disadvantage.

These are all significant disadvantages to the conventional approaches to demonstrating stereo equipment including loudspeakers. Other problems and drawbacks also exist.

SUMMARY OF THE INVENTION

An embodiment of the present invention comprises a virtual speaker demonstration system that permits a retail outlet to use a reference speaker to demonstrate the performance of multiple demonstration speakers. A user interface permits a user to select a demonstration speaker, and signal processing is performed so that the output from the reference speaker simulates the output of the selected demonstration speaker.

The virtual speaker demonstration system processes a characteristic selected from stored characteristics for a plurality of demonstration speakers in order to simulate the selected demonstration speaker. The virtual speaker demonstration system also processes a characteristic of the reference speaker in order to remove the effects of the reference speaker. The virtual speaker demonstration system processes an acoustic sample (such as music) in order to generate an aggregate acoustic output that represents what the acoustic sample would sound like if it were played through the selected demonstration speaker.

According to a further aspect of the invention, the virtual speaker demonstration system can include the effects of a demonstration environment by, for example, allowing a user to select from a plurality of possible room configurations (e.g., geometry and absorption parameters). In this case, the characteristic for the selected demonstration environment is processed to factor in its effects.

According to yet another aspect of the invention, the virtual speaker demonstration system can remove the effects of the reference environment (the listening room for the demonstration) by inverse filtering a characteristic for the reference environment to remove its effects.

The virtual demonstration system of the invention represents a significant advance over the prior art because the invention provides benefits to all parties: consumers, retailers, and manufacturers.

Consumers benefit because the invention permits the consumer to listen to and compare multiple demonstration speakers easily and conveniently from the same reference speaker. Consumers also benefit because the virtual demonstration provides a more accurate representation of how the demonstration speakers will sound in a particular environment. Therefore, consumers can make more informed purchase decisions leading to enhanced customer satisfaction.

Retailers benefit from the invention because the retailer can use a single reference speaker set to demonstrate the performance of multiple demonstration speakers, saving costs and space. Retailers also benefit from the enhanced customer satisfaction resulting in fewer returns and more repeat business. Retailers also benefit because they can display and demonstrate a wider variety of products than space and cost constraints would otherwise allow. Because of space limitations, retailers can only display, and thereby, sell a limited number of manufacturers' speakers. This invention would allow retailers to demonstrate and sell a much broader selection of manufacturer' speakers.

Manufacturers also benefit from enhanced customer satisfaction. Manufacturers also benefit because the invention provides a means for displaying and demonstrating a wider variety of the manufacturer's product line at retailers.

Accordingly, it is one object of the present invention to provide a virtual speaker demonstration system and method for simulating the performance of multiple demonstration speakers using a single reference speaker set.

It is another object of the present invention to provide a virtual speaker demonstration system that allows a retailer to reduce the amount of floor space required for speaker demonstration.

It is another object of the present invention to provide a virtual speaker demonstration system that reduces the complexity of wiring required for speaker demonstration.

It is yet another object of the present invention to provide a virtual speaker demonstration system that reduces the variables in comparing demonstration speakers so that comparisons are more even-handed.

It is yet another object of the present invention to provide a virtual speaker demonstration system that allows a user to evaluate the performance of demonstration speakers in selected physical environments.

The accompanying drawings are included to provide a further understanding of the invention and are incorporated in and constitute part of this specification, illustrate several embodiments of the invention and, together with the description, serve to explain the principles of the invention. It will become apparent from the drawings and detailed description that other objects, advantages and benefits of the invention also exist.

Additional features and advantages of the invention will be set forth in the description that follows, and in part will be apparent from the description, or may be learned by practice of the invention. The objectives and other advantages of the invention will be realized and attained by the systems and methods, particularly pointed out in the written description and claims hereof as well as the appended drawings.

BRIEF DESCRIPTION OF THE DRAWINGS

The purpose and advantages of the present invention will be apparent to those of skill in the art from the following detailed description in conjunction with the appended drawings in which like reference characters are used to indicate like elements, and in which:

FIG. 1A is an illustration of a typical prior art dedicated listening room for demonstrating loudspeakers.

FIG. 1B is an illustration of a typical prior art non-dedicated listening room for demonstrating loudspeakers.

To facilitate understanding, identical reference numerals have been used to denote identical elements common to the figures.

DETAILED DESCRIPTION OF THE INVENTION

Figure 2:
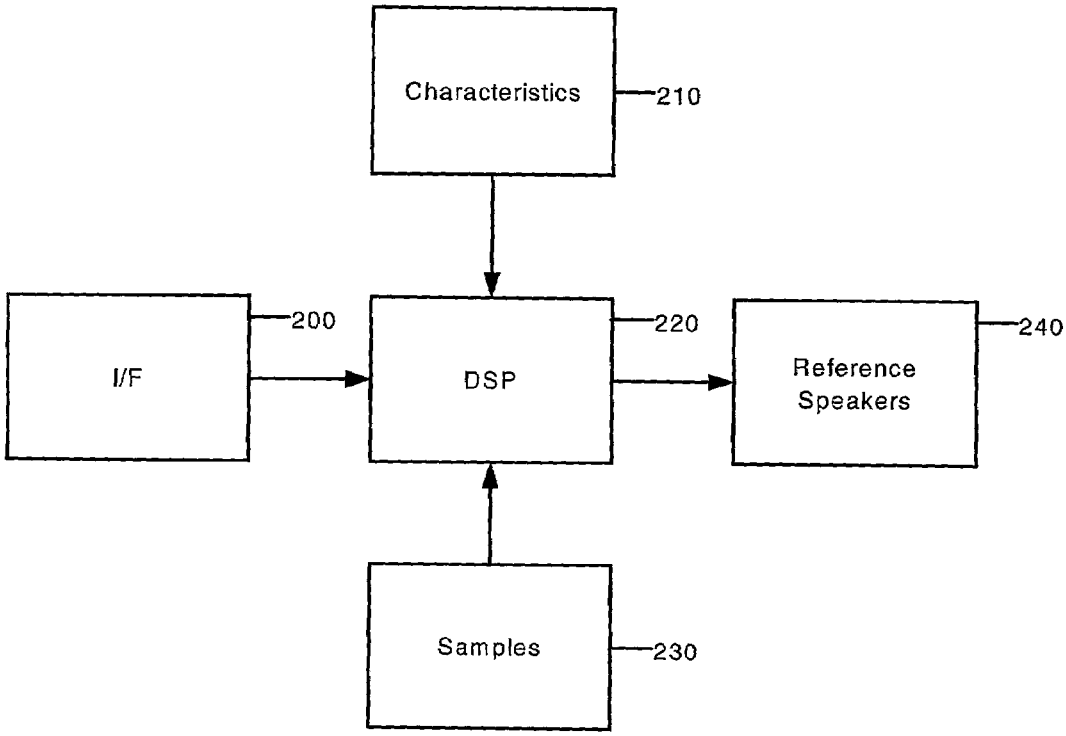
FIG. 2 is a block diagram of a virtual demonstration system according to an embodiment of the invention.

FIG. 2 is a block diagram of a virtual demonstration system according to an embodiment of the invention. The demonstration system includes interface 200, samples 230, characteristics 210, digital signal processor (DSP) 200, and reference speakers 240.

Generally, the operation of the demonstration system is as follows. A user, such as a consumer or other individual wishing to evaluate stereo equipment such as loudspeakers, accesses interface 200 in order to select various options. The options may include such parameters as the make, the model, environmental characteristics (e.g., a room or an interior of a vehicle), environmental conditions (e.g., speed, windows open/closed, etc.), and others further described below. The options may also include basic start (e.g., "Start Virtual Demonstration"), play (e.g., "Play Virtual Demonstration"), and stop (e.g., "End Virtual Demonstration") options. The interface 200 may include a keyboard, touch-screen, voice recognition module, mouse or similar point-and-click device, or any similar device usable for inputting selections.

Based on user-selected options, DSP 220 accesses characteristics 210 to retrieve appropriate characteristics and accesses samples 230 to input a sound sample. Characteristics 210 generally refer to transfer functions, impulse responses, or other mathematical descriptions that characterize acoustic performance. Characteristics 210 may be used to characterize and, therefore, account for, the effects of various components of an acoustic system on overall acoustic performance. For example, characteristics 210 may be characteristics for demonstration speakers, reference speakers, demonstration spaces (rooms or vehicle interiors), reference spaces (e.g., the listening room in a retail outlet where the virtual demonstration is presented), amplifiers, tuner/receivers, equalizers, and so forth. Additionally, in a beneficial embodiment (discussed further below) allowing the user to "build" his/her own demonstration space, characteristics 210 may include absorption parameters for various materials and geometry parameters which can be used to create a demonstration room.

Samples 230 are acoustic samples, such as samples of music, test sounds, spoken voice, etc. According to one approach, samples 230 are prestored in the virtual demonstration system and selected by the user via interface 200. According to another approach, samples 230 may be input by the user, such as via disk, CD, DVD, or other storage device for inputting acoustic samples to the demonstration system.

Using digital signal processing techniques, DSP 220 processes the appropriately retrieved characteristics 210 and samples 230 in order to produce an output representative of what the selected demonstration speakers will sound like in the selected environment. This output is played through reference speakers 240.

The user can then run the virtual demonstration again by selecting different options, such as a different set of demonstration speakers, a different environment, a different amplifier, and so forth. In each case, the user will be hearing the virtual output from the same location within the reference environment (i.e., the listening room) through the same reference speakers, thus permitting a convenient and fair ("apples to apples") comparison.

The virtual system of FIG. 2 is presented in simplified form in order to highlight the unique features of the invention. It should be understood that the virtual system may include various conventional operations, such as anti-aliasing filtering, digital-to-analog conversion (DAC), amplification, and various signal conditioning processes, before outputting the virtual signal through reference speakers 240.

The signal processing performed by DSP 220 in order to implement the invention is well understood in the art. Generally, characteristics of speakers, environments, amplifiers, and other components of the total acoustic system can be expressed as transfer functions (frequency domain) or impulse responses (time domain equivalent of the transfer function). These transfer functions can be determined analytically (through modeling and prediction, such as ray tracing) or empirically (through measurement). In a preferred embodiment of the invention the transfer functions are determined empirically.

For example, transfer functions of the various demonstration speakers supported by the virtual system can be measured in an anechoic chamber by stimulating the speakers with a basic acoustic input and the measuring the response. Preferably, the response is measured across a frequency spectrum of interest to users, such as about 5 Hz to 30,000 Hz, which goes beyond the typical range of human hearing but which will include the vibratory effects at the low and high ends. The measurement of the transfer function may be made at multiple angles with respect to the demonstration speaker (to derive a response which is a function of angle) or at a single on-axis point for simplicity.

According to one embodiment of the invention, the transfer functions of both the demonstration speakers and the reference speakers are measured. This permits the effects of the reference speakers to be removed and the effects of the selected demonstration speaker to be inserted.

The transfer functions of the environments can be measured in analogous fashions. For example, the virtual system may include options for various demonstration environments (rooms or vehicle interiors). The transfer functions for these demonstration environments can be determined analytically or empirically. If determined analytically, ray tracing or other acoustic modeling techniques are used to predict an impulse response for an analytic demonstration environment defined by geometric parameters, materials and absorption coeffecients. If determined empirically, actual demonstration environments are constructed and then stimulated with a known acoustic input through a speaker or transducer with known transfer characteristics. The impulse response of the demonstration environment can then be extracted used well known principles of acoustic signal processing.

According to one embodiment of the invention, the transfer functions of both the demonstration environment and the reference environment are measured. This permits the effects of the reference environment to be removed and the effects of the selected demonstration environment to be inserted. According to a preferred embodiment of the invention, convenience and cost suggests that the reference environment be measured empirically and the various demonstration environments be computed analytically.

The transfer functions of other components in the overall acoustic system can be determined in analogous fashions. For example, the virtual demonstration system may include a reference amplifier for powering the demonstration, but the user may be allowed to select a demonstration amplifier. For example, the user might want to comparatively assess the performance of speaker set 1 versus speaker set 2 where each is powered by amplifier X. In order to support this capability, the virtual demonstration system may provide for the transfer characteristics of various demonstration amplifiers (note: amplifiers is construed broadly here, and could include receivers or separate amplifier/tuners) to be predicted/measured (or provided by a manufacturer) and stored. Preferably, the transfer characteristics of the reference amplifier are known and can be removed before the characteristics of the selected demonstration amplifier are inserted.

DSP 200 performs the digital signal processing to product the virtual output. DSP 200 may be a processor, microprocessor, microcontroller, computer, or similar device. The principles behind the operations performed by DSP 200 are well understood in the art. The reader is referred to the following texts for background on signal processing operations (e.g., inverse filtering, compensation, time domain filtering, frequency domain filtering, and so forth) that may be used to implement the invention: A. V. Oppenheim & R. W. Schafer, *Digital Signal Processing* (Prentice-Hall: 1975); B. Widrow & S. D. Steams, *Adaptive Signal Processing* (Prentice-Hall: 1985); P. A. Nelson & S. J. Elliot, *Active Control of Sound* (Harcourt Brace: 1992); J. S. Bendat and A. G. Piersol, *Random Data* (John Wiley & Sons: 1986); *Reference Data for Engineers, 9th* ed. (Butterworth-Heinmann: 2002); and L. R. Rabiner & R. W. Schafer, *Digital*

*Processing of Speech Signals* (Prentice-Hall: 1978). Exemplary operations that may be performed by DSP 220 are discussed further in connection with FIG. 7.

Figure 3:
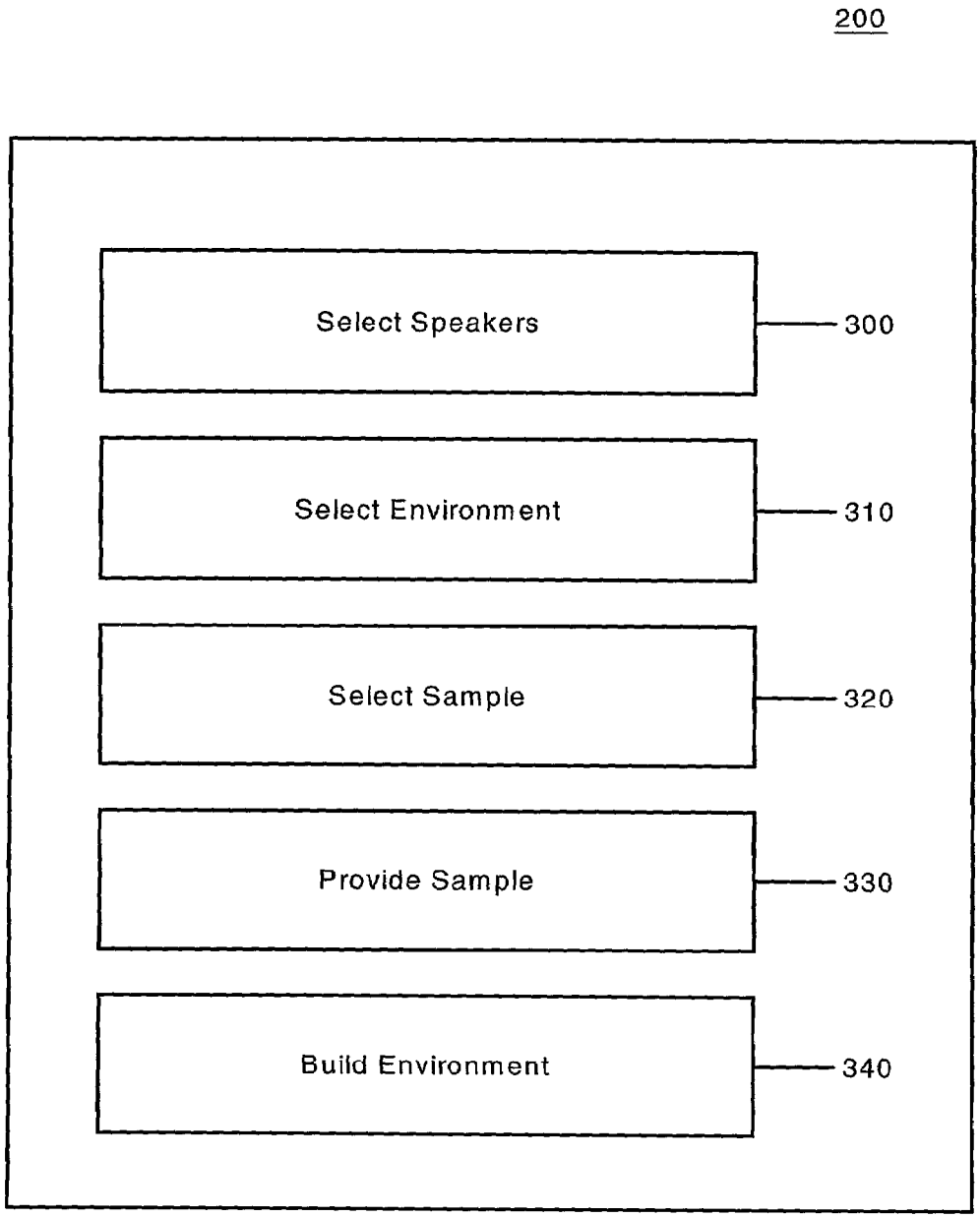
FIG. 3 is a block diagram of an exemplary user interface according to an embodiment of the invention.

FIG. 3 is a block diagram of an exemplary user interface according to an embodiment of the invention. Interface 200 includes options to select speakers 300, select environment 310, select a sample 320, provide a sample 330, and build an environment 340.

Select speakers 300 allows a user to select demonstration speakers for evaluation. This option may include further suboptions for selecting a make (e.g., a manufacturer like Pioneer) and a model (e.g., Pioneer 1000 Series).

Select environment 310 allows a user to select the demonstration environment. Generally, select environment 310 relates to characteristics that are already determined (computed or measured). This option may provide a textual and/or graphical list of demonstration environments which characteristics are readily accessible to DSP 220. The demonstration environments may be a room or auditorium in a building, or may be the interior of a vehicle. In that latter scenario, there may be suboptions for selecting a make (e.g., a car manufacturer such as BMW) and a model (e.g., Model 540). Select environment 310 may allow the user to modify a demonstration environment or select between various options (e.g., change a room size or select between carpet/no carpet or convertible/hardtop).

Select sample 320 provides options for the acoustic sample that is played through the virtual demonstration system. Select sample 320 may include music (portions or the entirety of songs), test samples (tones, white noise, etc.), spoken audio, and the like. Based on the user's selection, select sample 320 causes the DSP 220 to retrieve and process the selected acoustic sample.

Provide sample 330 allows a user to input his/her own acoustic sample from a storage means such as a disk, CD, DVD, and so forth. Provide sample 330 may include submenus for directing the user to insert the storage means into a reader, select the desired acoustic sample (e.g., a portion of a song on track 5), crop the time domain data down to an appropriate size, and so forth.

Build environment 340 provides an option for a user to build a demonstration environment. For example, this option may allow the user to simulate the room or auditorium in which loudspeakers will be placed. This option may allow the user to compare the performance of various demonstration rooms in order to decide which to build in his/her home or building. Build environment 340 includes submenus so that the user can graphically build the demonstration room by selecting geometries and materials. Materials may automatically be linked to stored absorption parameters. Once the user has input the geometry and material selections, build environment 340 analytically generates the characteristics for the demonstration environment, such as by running a ray trace model or other acoustic prediction model.

Figure 4:
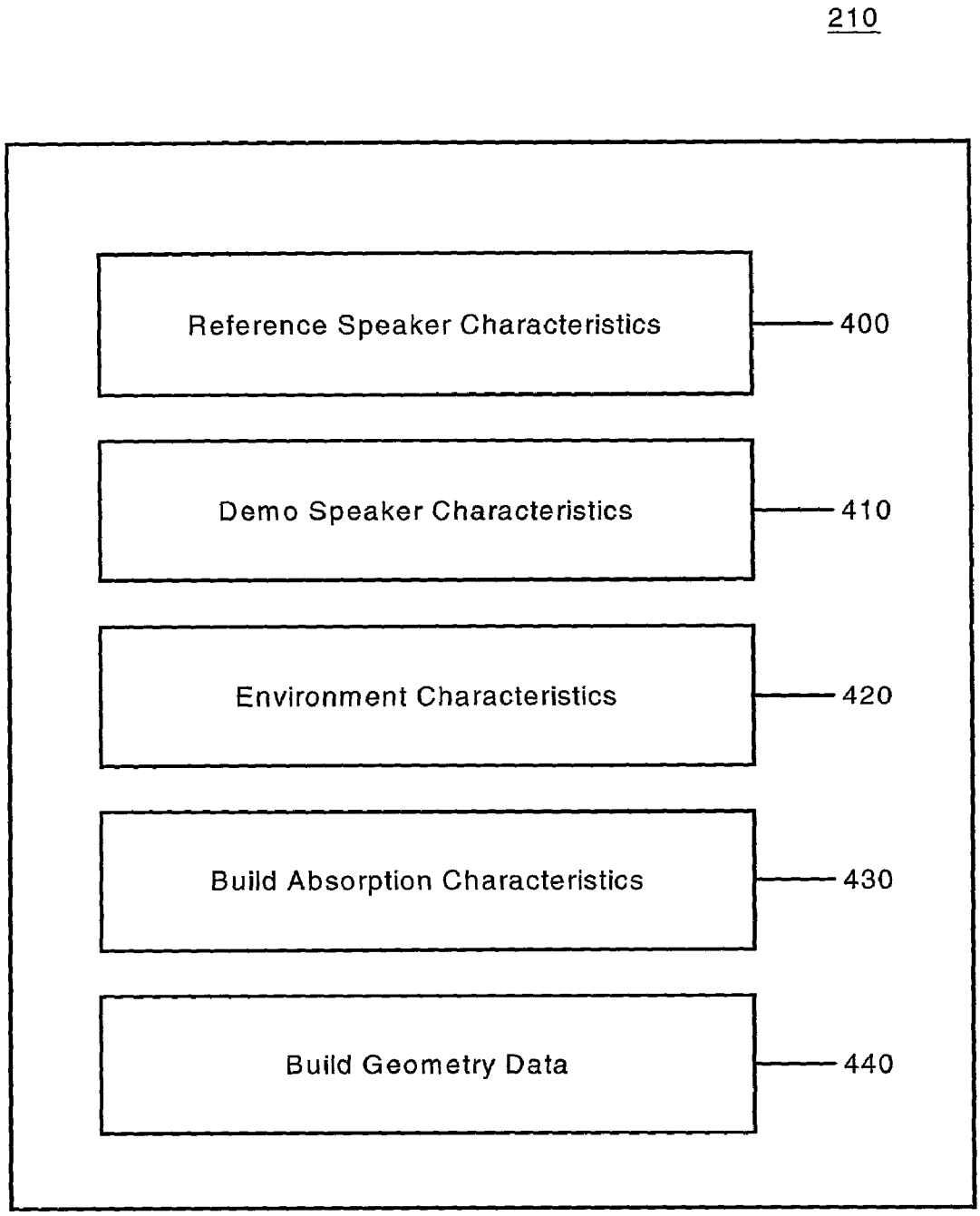
FIG. 4 is a block diagram of the exemplary characteristics that may be used by the virtual demonstration system.

FIG. 4 is a block diagram of the exemplary characteristics that may be used by the virtual demonstration system. Exemplary characteristics 210 may include reference speaker characteristic 400, demonstration speaker characteristics 410, environment characteristics 420, build absorption characteristics 430, and build geometry data 440.

Reference speaker characteristics 400 has the characteristics of the reference speakers used for the virtual demonstration system. These characteristics may be a transfer function, impulse response function, or equivalent mathematical description of the acoustic performance of the reference speaker. These characteristics are used to remove the effects of the reference speakers, such as by inverse filtering.

Demonstration speaker characteristics 410 has the characteristics of the various demonstration speakers that the virtual system is capable of simulating. These characteristics may be represented similar to those for the reference speakers. The demonstration speaker characteristics 410 are used to insert the effects of the demonstration speakers, such as by digital filtering (e.g., convolution, infinite impulse response [IIR], or finite impulse response [FIR], operations in the time domain or multiplication in the frequency domain).

Environmental characteristics 420 has the characteristics of the various demonstration environments that are supported by the virtual system. This module may also include the characteristic of the reference room so that its effects can be removed.

Build absorption characteristics 430 contains absorption figures corresponding to various materials. Exemplary absorption parameters are provided in Chapter 10, Table 10, of *Reference Data for Engineers,* $9^{th}$ ed. (Butterworth-Heinmann: 2002). The materials may be such things as carpet, hardwood, drapes, and so forth.

Build geometry data 440 contains selectable geometries (blocks, rectangles, stairs, floors, ceilings, etc.) that can be used in a CAD-CAM like fashion to generate a demonstration environment.

Figure 5:
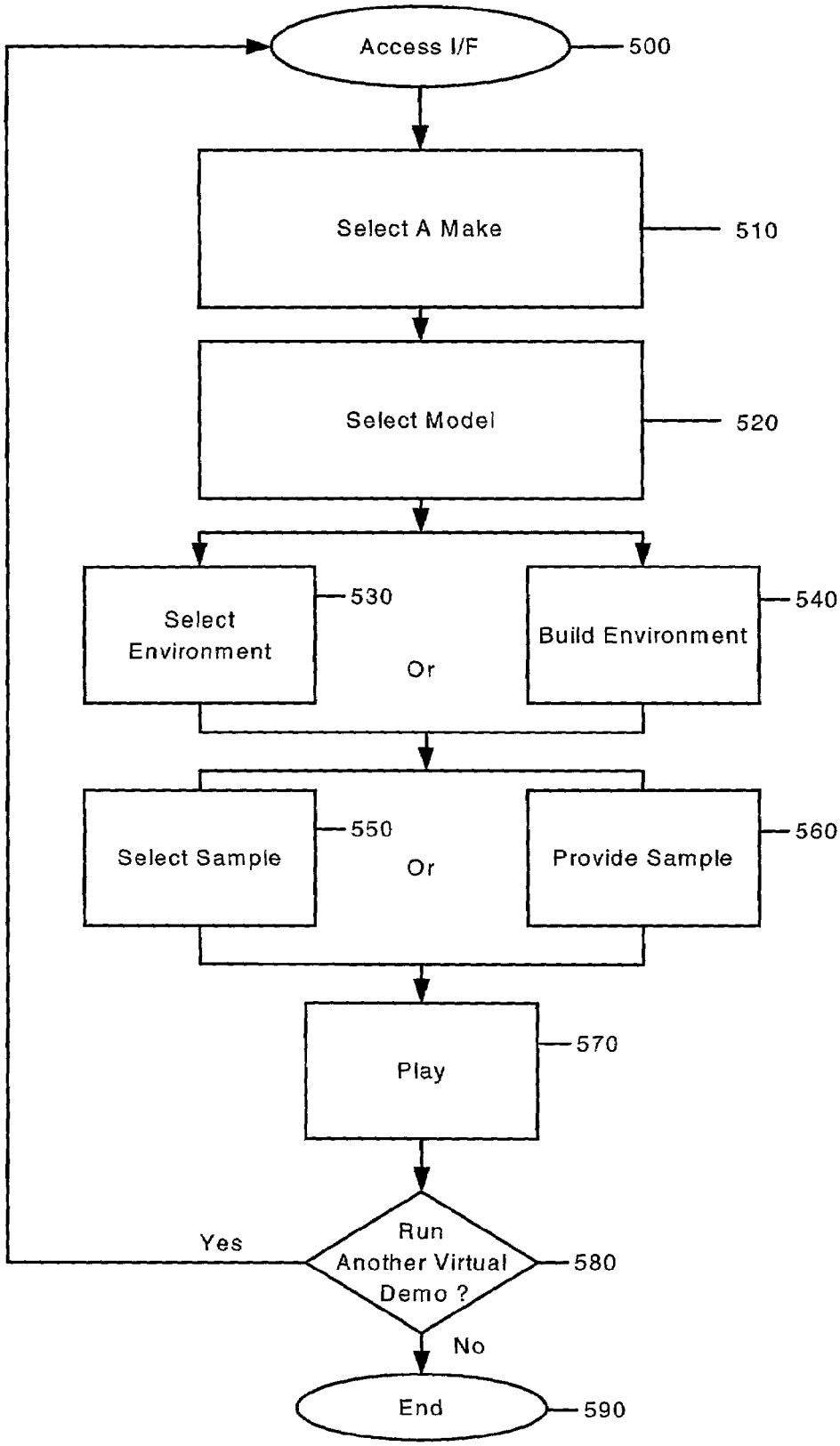
FIG. 5 is a flow diagram of a method for a user to engage the virtual demonstration system according to an embodiment of the invention.

FIG. 5 is a flow diagram of a method for a user to engage the virtual demonstration system according to an embodiment of the invention. In step 500, the user accesses the interface. In step 510, the user selects a make (e.g., Pioneer). In step 520, the user selects a model (e.g., Series 1000). In step 530, the user can select a demonstration environment for which the characteristics are already stored by the virtual demonstration system. Alternatively, in step 540 the user can build an environment by selecting materials and geometries.

In step 550, the user can select an acoustic sample to play through the virtual system. Alternatively, in step 560 the user can opt to provide a sample via storage means such as a CD, DVD, disk, or the like. According to one beneficial embodiment, the virtual system includes an option to link to the Internet so that the user can download an acoustic sample.

In step 570, the user plays the virtual demonstration. In step 580, the user decides whether to run another virtual demonstration to compare different demonstration speakers and/or different demonstration environments. The virtual system beneficially stores the selections from the last run so that they can be used for the next run. For example, the user will not have to recreate the demonstration environment in run #2. Instead, he/she can simply select the one from the last run.

The method ends at 590.

Figure 6:
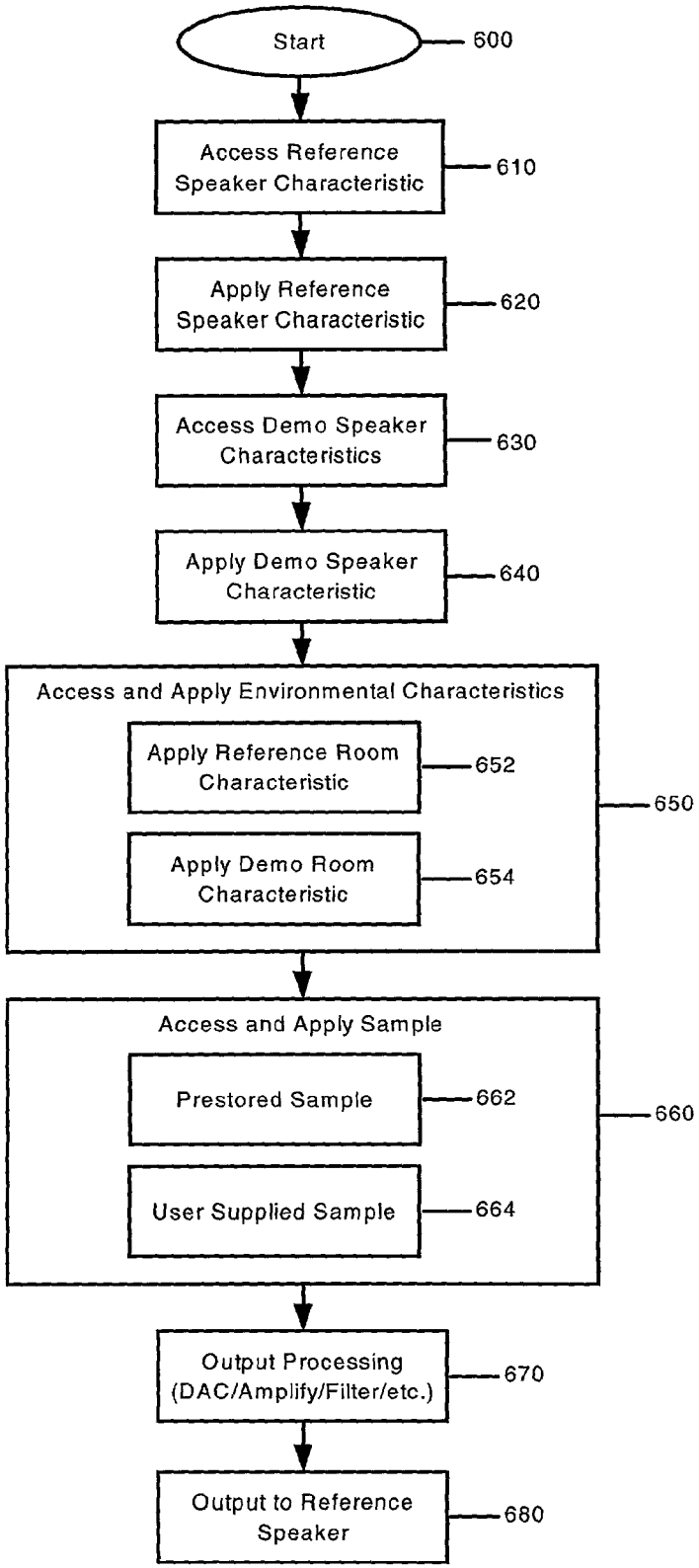
FIG. 6 is a flow diagram of a method creating a virtual demonstration according to an embodiment of the invention.

FIG. 6 is a flow diagram of a method creating a virtual demonstration according to an embodiment of the invention. After the method starts at 600, the virtual demonstration system accesses the reference speaker characteristic at 610, and applies the reference speaker characteristic at 620. The application could be performed, for example, by inverse filtering in the frequency domain or time domain.

In step 630, the virtual system accesses the demonstration speaker characteristics at 630 to retrieve a characteristic corresponding to a selected demonstration speaker, and at 640, the virtual system applies the retrieved characteristic. This application could be performed, for example, by filtering in the frequency domain or time domain.

In step 650, the virtual system accesses and applies environmental characteristics. For example, in step 652 the reference room characteristic may be applied in order to remove its effects. In step 654, a demonstration environment characteristic corresponding to a selected demonstration environment is retrieved and applied in order to include its effects.

In step 660, the virtual system accesses and applies an acoustic sample. For example, in step 662 a prestored acoustic sample that was selected by the user is applied by the virtual system. For example, in step 664 a user-supplied (e.g., via storage means or from the Internet) acoustic sample is applied by the virtual system. The application of the acoustic sample could be performed, for example, by filtering the acoustic sample input with in the characteristics of the reference speaker and/or demonstration speaker and/or demonstration environment in the time domain or the frequency domain.

In step 670, the virtual system performs any ancillary output processing such as digital-to-analog conversion, filtering, amplification, signal conditioning, and so forth, before outputting the virtual signal to the reference speakers in step 680.

Figure 7:
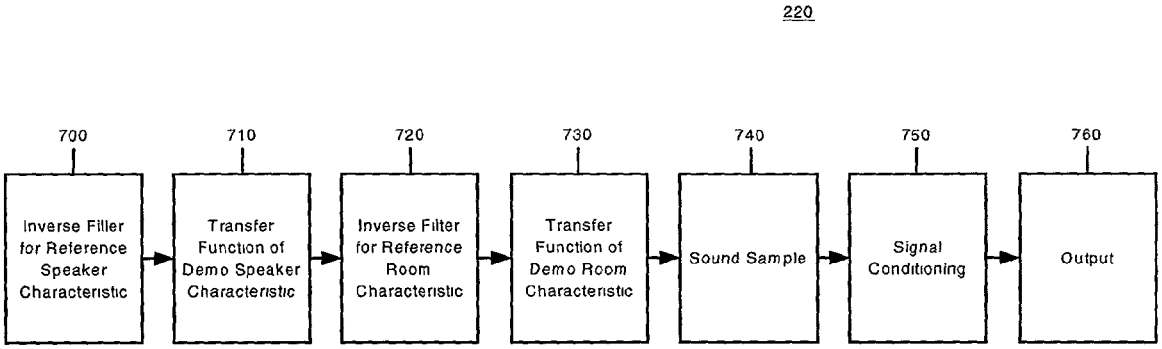
FIG. 7 is a block diagram of the digital signal processing that may be employed for the virtual demonstration according to an embodiment of the invention.

FIG. 7 is a block diagram of the digital signal processing that may be employed by DSP 220 according to an embodiment of the invention. Because the overall acoustic system is treatable as a linear system, the ordering of the operations in FIG. 7 can be changed. In block 700, inverse filtering to remove the contribution or bias of the reference speakers is performed. In block 710, the transfer function characteristic of the demonstration speaker is applied. In block 720, inverse filtering is performed to remove the contribution or bias of the reference room. In block 730, the transfer function characteristic of the demonstration room is applied. In block 740, the acoustic sample is applied. In step 750, various signal conditioning and digital-to-analog operations are performed before the virtual signal is output at block 760.

It should be understood that the various filtering operations of FIG. 7 can be implemented in the time domain (e.g., convolution, infinite impulse response [IIR] filter, finite impulse response [FIR] filter) or frequency domain.

Figure 8:
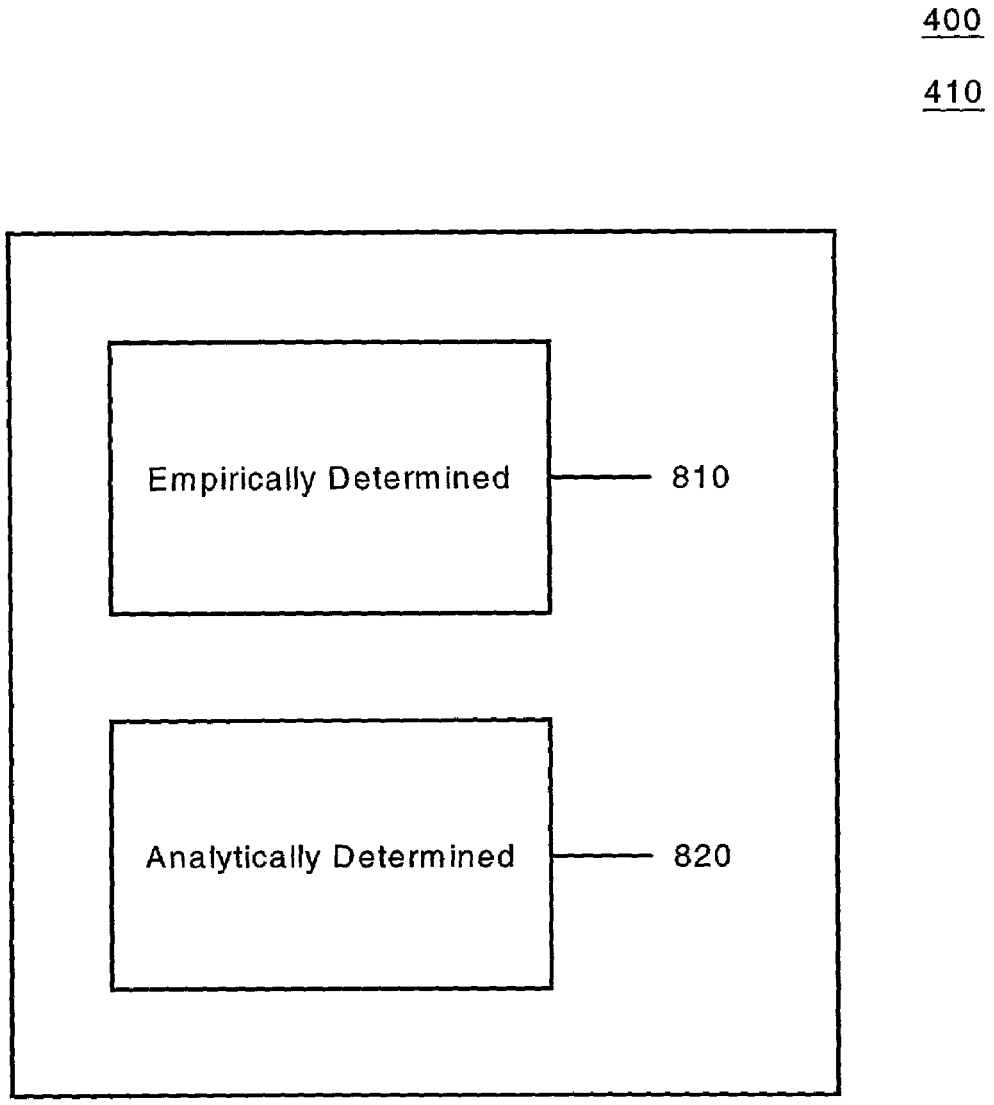
FIG. 8 is a block diagram of the loudspeaker characteristics that may be employed for the virtual demonstration according to an embodiment of the invention.

FIG. 8 is a block diagram of the loudspeaker characteristics that may be employed for the virtual demonstration according to an embodiment of the invention. Reference speaker characteristics 400 and demonstration speaker characteristics 410 may be empirically determined 810 and/or analytically determined 820, as previously discussed.

Figure 9:
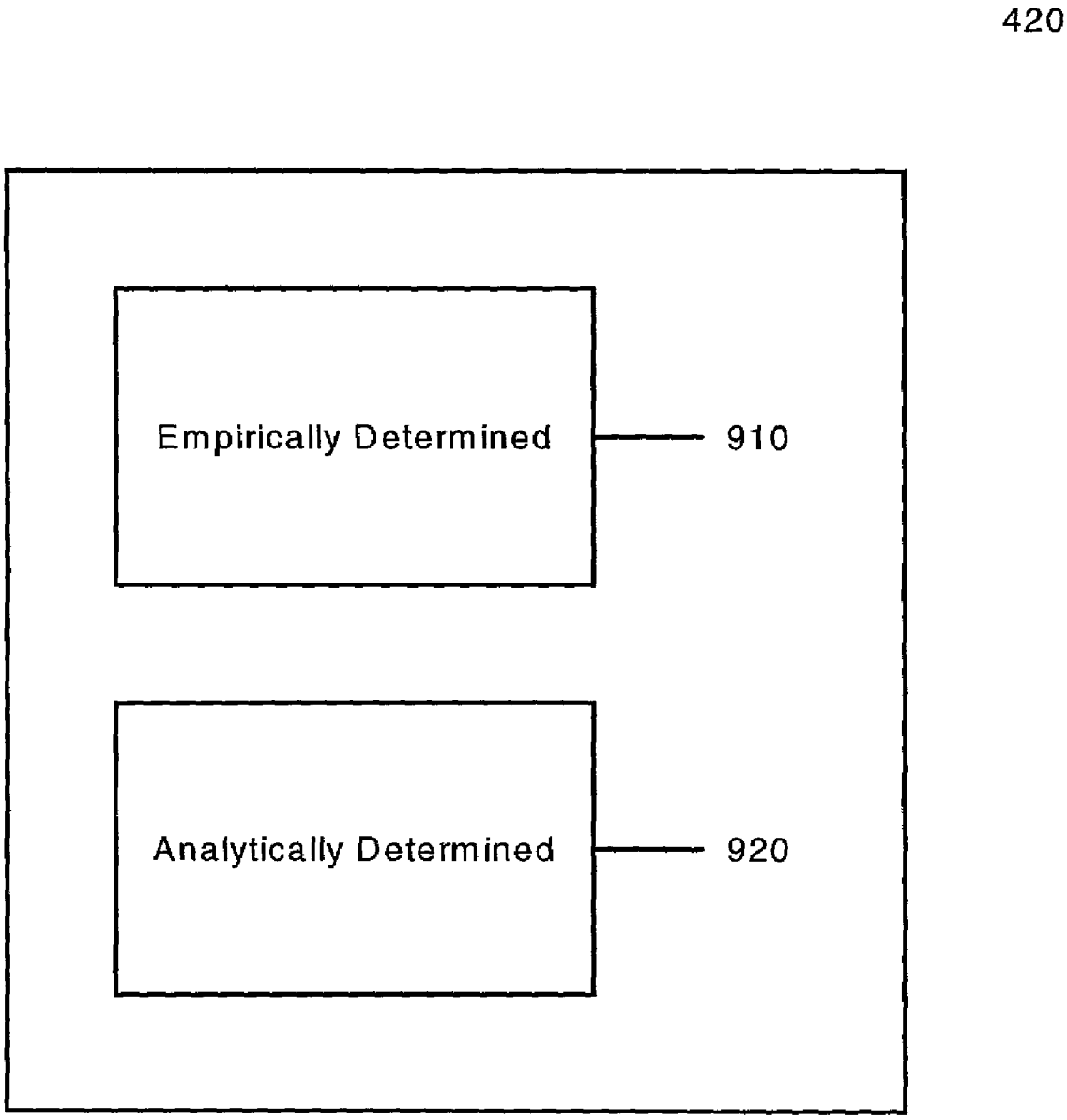
FIG. 9 is a block diagram of the environmental characteristics that may be employed for the virtual demonstration according to an embodiment of the invention.

FIG. 9 is a block diagram of the environmental characteristics that may be employed for the virtual demonstration according to an embodiment of the invention. Similar to FIG. 8, environmental characteristics 420 may be empirically determined 910 and/or analytically determined 920, as previously discussed.

Figure 10:
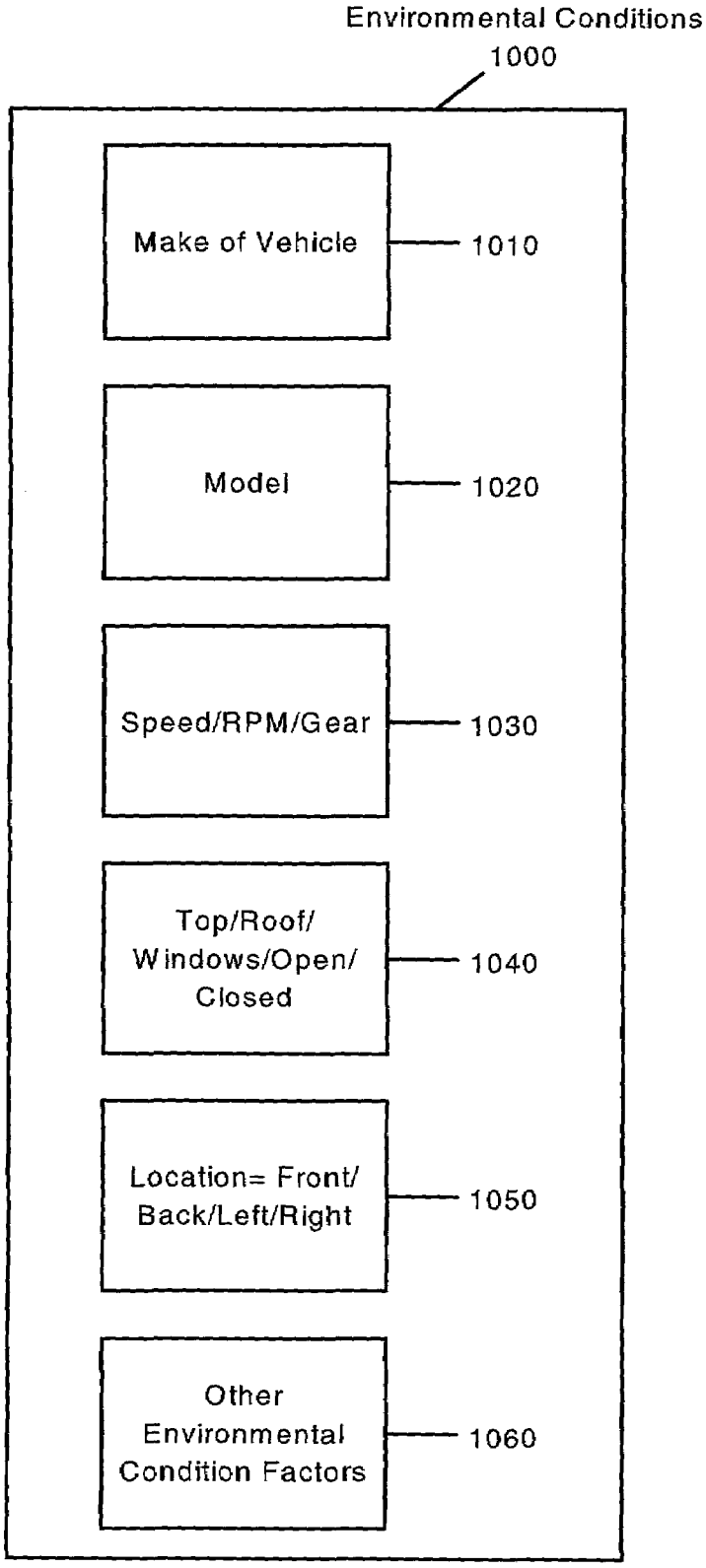
FIG. 10 is a block diagram of environmental conditions that may be employed for the virtual demonstration according to an embodiment of the invention.

FIG. 10 is a block diagram of environmental conditions that may be employed for the virtual demonstration according to an embodiment of the invention. Environmental conditions 1000 generally represents an additional set of options that can be selected by the user via interface 200. For example, in an embodiment of the invention permitting the environmental space to correspond to the interior of a vehicle like a car, environmental conditions 1000 can be used to set various operational parameters. For example, environmental conditions 1000 may allow the user to select a vehicle make 1010, model 1020, speed and/or RPM and/or gear 1030, top and/or roof and/or windows open or closed 1040, seating location front/back/left/right 1050, and other environmental factors 1060.

Environmental conditions 1000 permits a user to hear the virtual demonstration in an acoustic environment of his/her selection. This acoustic environment (e.g., a BMW 328i, 50 mph, $4^{th}$ gear, 3200 RPM, windows closed, drivers seat) is preferably provided by the virtual demonstration system based on empirical data measurements. This acoustic environment can be combined with the other components of the overall acoustic system (e.g., demonstration speakers) using conventional DSP processing techniques to allow the user to hear the simulated performance of the demonstration system in a vehicle in operation.

According to another beneficial aspect of the invention, the virtual demonstration system can permit a user to experience the simulated acoustic environment without demonstration speakers or an input acoustic sample. In other words, a user may not be interested in stereo equipment at all. Rather, the user is interested in making a vehicle purchase or lease, and wishes to compare the acoustic performance of competing models. Therefore, the virtual demonstration system functions as a virtual noise simulation system. This application is readily extendible to other vehicles, such as planes (e.g., for flight simulation), boats (marine simulators), and the like.

Figure 11:
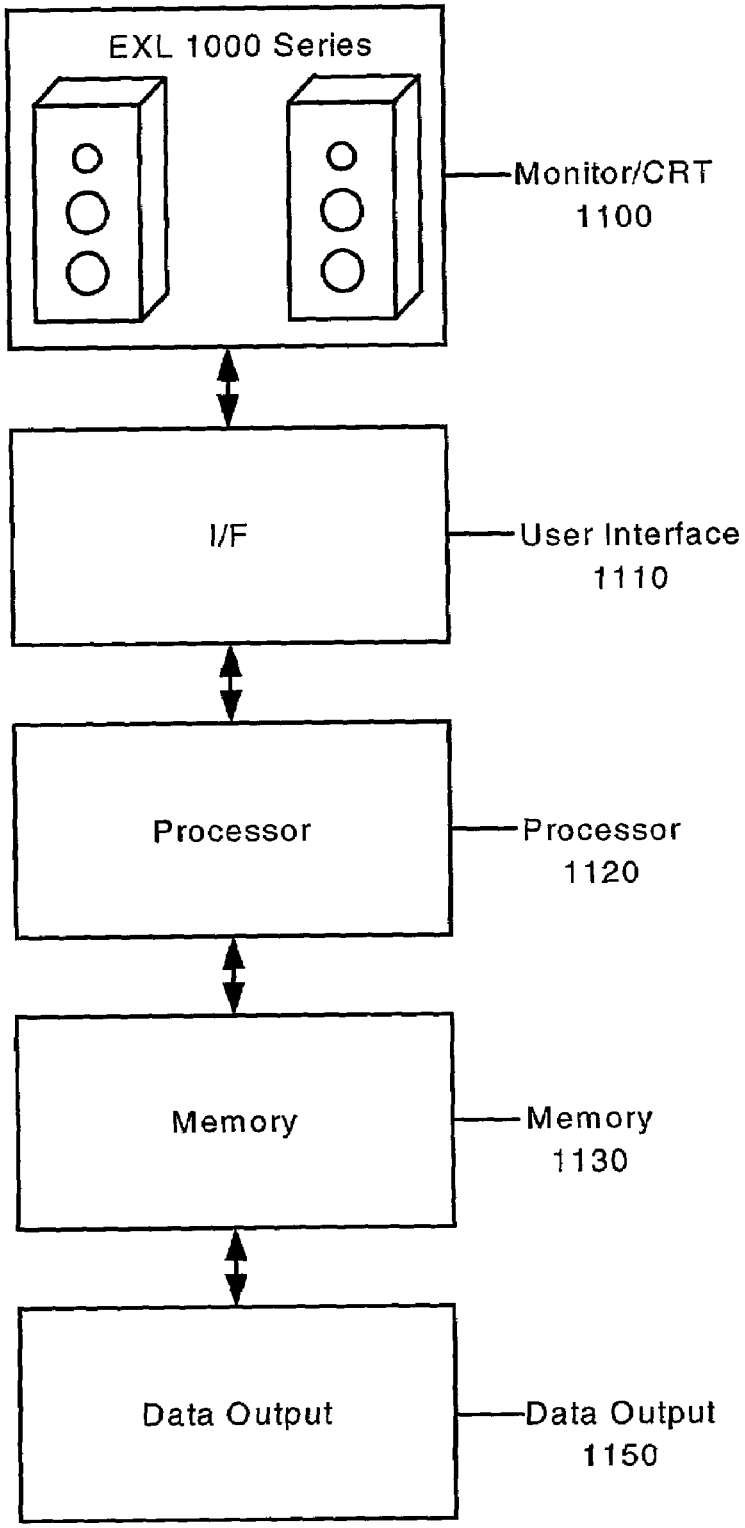
FIG. 11 is a block diagram of a system for a virtual demonstration system according to an embodiment of the invention.

FIG. 11 is a block diagram of a system for a virtual demonstration system implemented in a retail outlet. The system includes a memory 1130 for storing characteristics and acoustic samples, a processor 1120 for performing DSP processing, a user interface 1110 for allowing a user to select options, a monitor/CRT 1100 for presenting a visual of the demonstration speakers, and a data output 1150 for providing data to the user regarding the virtually demonstrated equipment.

Monitor/CRT 1100 richens the user's experience because he/she now not only hears the demonstration speaker, but sees them as well. The purchase experience is informed not only by the what the equipment sounds like, but also by what it looks like. Monitor/CRT 1100 can be any suitable graphical display for displaying the demonstration speaker, such as a computer display (CRT), television display, and so forth. If the user is getting a demonstration of other equipment, such as an amplifier, monitor/CRT 1100 may display an image of that other equipment.

Data output 1150 provides data to the user regarding the equipment that is evaluated. For example, data output 1150 may output the specifications, product manuals, sales information (cost, financing options, sales prices, and the like) and/or pictures (photos or graphical images) of the equipment. Data output 1150 may be a color or black-and-white printer or memory output device (disk writer or CD writer) that can output information to the user who can then take the information home to further assess his/her contemplated purchase. For example, the user can take photos or graphical images of the demonstration speakers home to see how well their design blends with the user's décor at home.

Data output 1150 could also be a device for outputting data regarding the evaluated equipment to the user electronically over the Internet or via e-mail. For example, data output 1150 could include or be coupled to a web server for posting information on a web site accessible to the user. Data output 1150 could include or be coupled to an email server for sending an e-mail to the user with the data.

Figure 12:
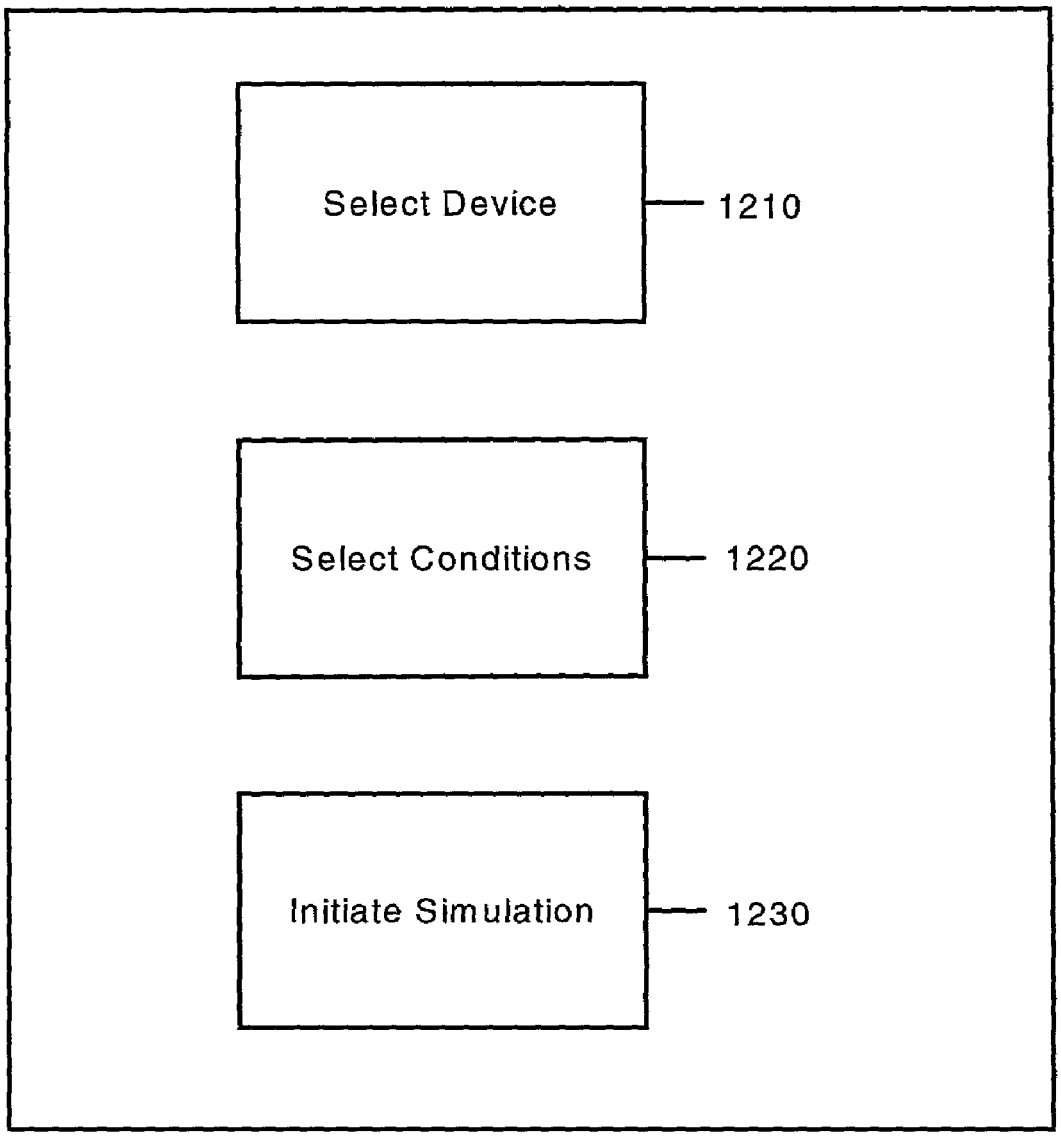
FIG. 12 is a block diagram of an interface for a user to initiate a virtual noise simulation according to an embodiment of the invention.

FIG. 12 is a block diagram of an interface for a user to initiate a virtual noise simulation according to an embodiment of the invention discussed above for FIG. 10. In FIG. 12, the user can select a device to be simulated at 1210. For example, a car or plane or other device (make/model). The user can select conditions at 1210 (speed/RPM/gear, overtorque, ice breaking off propellers, depressurization, etc.). The user can then initiate the virtual noise simulation at 1230.

Having described the virtual demonstration system according to several embodiments, it can be appreciated that numerous benefits flow from the invention that benefit all three of the consumer, the retailer, and the manufacturer.

The consumer benefits because he/she can listen to and compare multiple demonstration speakers easily and conveniently from the same reference speaker. The consumer also benefits because the virtual demonstration provides a more accurate representation of how the demonstration speakers will sound. Therefore, the consumer can make a more informed purchase decision leading to enhanced customer satisfaction.

The brick-and-mortar retailer benefits because the retailer can use a single reference speaker set to demonstrate the performance of multiple demonstration speakers, saving costs and space, and allowing the retailer to demonstrate a wider range of products. Because of space limitations, retailers can only display, and thereby, sell a limited number of manufacturer' speakers. This invention allows retailers to demonstrate and sell a much broader selection of manufacturer' speakers.

On-line retailers benefit because the retailer can provide demonstrations at the consumer's home or office that heretofore have not been possible. Until now, one of the significant shortcomings of on-line stereo retailing versus traditional in-store retailing was that the on-line retailer had no way to demonstrate its speaker products. With the advent of the invention, this is no longer the case and, in fact, the on-line retailer's ability to provide virtual demonstration to the consumer in the convenience and comfort of the consumer's home may give on-line retailers an advantage over brick-and-mortar retailers.

Additionally, both on-line and brick-and-mortar retailers also benefit from the enhanced customer satisfaction resulting in fewer returns and more repeat business.

Manufacturers also benefit from the invention. Manufacturers benefit from enhanced customer satisfaction. Manufacturers also benefit because the invention provides a means for displaying and demonstrating a wider variety of the manufacturer's product line at retailers.

As it should be clear to those of ordinary skill in the art, further embodiments of the present invention may be made without departing from its teachings and all such embodiments are considered to be within the spirit of the present invention.

For example, the reference speakers of the virtual demonstration system could easily be replaced by high-end headphones so that the user would not need a reference room to experience the virtual demonstration. This embodiment is especially advantageous because it would remove the necessity for accounting for the bias imparted by a reference listening room. Referring to FIG. 7, block 720 for filtering to remove the effects of the reference room would not be required because effectively there would be no reference room if headphones are used as the reference speakers.

Reference headphones could be used in the virtual demonstration system to demonstrate demonstration headphones. Thus, one set of high-quality reference headphones could be used to virtually demonstrate the performance of multiple sets of headphones.

It should also be understood that the virtual demonstration system could be implemented in a wide variety of contexts beyond the traditional electronics retail outlet. Some of these venues have been described above (churches, auditoriums, etc.). Depending on the product, other venues that would benefit from the invention may include car, motorcycle, recreational vehicle (RV), and boat outlets; trade shows and similar public shows (e.g., auto shows, boat shows, home/commercial builder shows, etc.).

As suggested above, the invention can be considered to have two basic aspects: a virtual demonstration aspect (for demonstrating the performance of electronics equipment like speakers, amplifiers, and the like) and a virtual noise simulation aspect (for simulating various acoustic environments, like the noise inside of a car or plane during operation). In some cases, an application will involve both aspects of the invention, such as when a consumer desires to hear the performance of a set of demonstration speakers (virtual demonstration aspect) in a BMW 328i at 50 m.p.h., 3000 RPM, $4^{th}$ gear, with the windows open (virtual noise simulation aspect).

In other cases, an application will involve only one aspect of the invention, such as when a consumer wishes to evaluate or experience the acoustic conditions of various cars, planes, boats, and the like. The consumer may wish to compare noise levels in cars during various operating conditions, as previously discussed. The consumer may wish to compare noise levels for various options for a given car, such as a six-cylinder engine versus eight-cylinder engine, stick shift versus automatic, wide sport tires versus standard tires, convertible versus hard-top, headlights up versus down, windows up versus down, top up versus closed, and so forth.

In another context, outboard engine manufacturers or retailers can use the virtual noise simulation aspect of the invention in order to provide a simulation of engine noise for a boat in operation. The system would allow selection of various options which characteristics would be processed to generate a simulated noise output. The various options could include such things as engine type, boat type/shape/geometry, speed, RPM, sea state (wave height), two-cycle versus four-cycle engine, various power settings, various locations in the boat (forward, aft, left, right, deck, below), distance from shore, and so forth.

Other examples of applications for virtual noise simulation might be found in other consumer, educational, regulatory, and industrial applications. As just one example, active noise cancellation (ANC) is now finding application in consumer and industrial settings. The virtual noise simulation aspect of the present invention would find beneficial application to demonstrating the efficacy of active noise cancellation. For example, a firm developing and marketing high-end active noise cancellation technology to large industry companies would obviously benefit from being able to demonstrate the improvement in noise levels that an ANC installation would bring.

As suggested above, the virtual demonstration system software could be packaged for use in a home or office using high quality reference speakers or headphones. The software could be provided by disk or other storage media or, alternatively, could be made available for download over the Internet. For so-called "on-line" retailers not having traditional "brick & mortar" outlets, this embodiment could be extremely beneficial. Preferably, this embodiment would include interface options for selecting the type of reference speakers or headphones to be used for specific users so that their effects can be compensated. In a further variation to this approach, the user could use high performance reference speakers in the form of free-standing speakers (e.g., floor speakers, speakers on a stand, bookshelf speakers, etc.) or headphones provided by the retailer or another entity (e.g., club, friend, speaker manufacturer, other business, band, etc.). This embodiment has the advantage that the user need not own any special equipment to experience the virtual demonstration in the comfort of his/her home or office using basic computer hardware, such as a personal computer.

According to a further variation of the invention, virtual demonstration software could be run by the user in conjunction with basic home speakers for virtually demonstrating car audio speakers. Most basic home speakers will have adequate acoustic performance to simulate the performance of car speakers. Thus, a user could practice the invention in accordance with the exemplary embodiments of FIGS. 3, 5, 10, and 12, in order to virtually demonstrate the performance of car speakers in an operational environment (make/model of car, speed, RPM, windows up/down, etc.).

According to yet another variation, a retailer, audio systems contractor, or other business ("demonstrator") could use the virtual demonstration system of the invention in order to provide on-site demonstrations of various demonstration speakers under different environmental conditions. For example, a demonstrator could bring portable versions of the virtual demonstration system with a set of reference speakers to a place of worship, auditorium, home, office, industrial facility, club, theater, school, or the like in order to demonstrate performance of various reference speakers and other equipment (e.g., amplifiers of varying grades and powers). In such a case, the user interface may provide an option to exclude any compensation for environment because no reference environment is being used and no demonstration environment is selected. Rather, the actual listening environment is being used.

In some cases, a customer would request that the demonstration take place in a room or building that is not completed so that an interim assessment can be made. Such an interim assessment could include virtually demonstrating the impact of various materials (e.g., furniture, acoustic tile and panels, carpeting, drapery, etc.) so that the customer could make decisions on material selection based on expected acoustic performance. Such an interim assessment might entail the measurement or prediction of the transfer characteristic (or impulse response) of the existing space where the demonstration would take place.

Additionally, while the reference speakers are generally discussed in terms of pairs of speakers, the virtual demonstration system could easily employ further speakers so that "surround sound" effects could be simulated.

Additionally, the build environment feature of the invention can be made relatively simple or complex depending on the sophistication and needs of the average user. For example, the user may be asked to identify: the percentage of wall surfaces using highly reflective materials (e.g., glass, wood paneling, untreated drywall, etc.), the percentage of wall surfaces covered with absorptive materials (e.g., curtains or fabric wall art), the nature of the floor material (e.g., wood, vinyl, or carpet), the composition of the ceiling (e.g., acoustic tile, wood paneling or drywall), the ceiling design (e.g. flat or cathedral), the density of upholstered furniture (e.g., high, medium, or low), and/or the shape of the room.

Additionally, it should be understood that the components of the virtual demonstration system need not be collocated in one place. For example, referring to FIG. 2, an implementation at a retail outlet may have the interface 200, DSP 220, and reference speakers 240 in the listening room, while the characteristics 210 and samples 230 may be remotely located. For example, the characteristics 210 and/or samples 230 may be located at one or more web sites or non-Internet remote servers maintained by the retailer or by the manufacturers. If maintained by the manufacturers, this beneficial embodiment would allow manufacturers to update and revise their demonstration speaker characteristics as they change or as new models are released to market.

In a similar variation where the user is a consumer at home or at a business site, the interface 200, DSP 220 and reference speakers 240 are at the user's remote site, while the characteristics are maintained by the retailer and/or a manufacturer at a web site or non-Internet remote server.

For typical retailers having stores with listening rooms, the invention could be beneficially applied so that each manufacturer would need to supply only their best, top-of-the-line speaker. This speaker could be used as the reference speaker for that manufacturer, and the various DSP operations and demonstration characteristics could be applied to virtually demonstrate the manufacturer's other speakers through the top-of-the-line model. This application would allow each manufacturer to demonstrate the entire line, while allowing the retailer to save valuable floor space.

Additionally, it should be understood that the various operations are presented so as to best explain the invention in a clear manner. These operations could easily be further divided or combined. For example, in FIG. 7 the filtering operations for the reference speakers (block 700) and the demonstration speakers (block 710) could easily be combined into a single operation.

Therefore, it is intended that all matter contained in above description or shown in the accompanying drawings shall be interpreted as exemplary and not limiting, and it is contemplated that the appended claims will cover any other such embodiments or modifications as fall within the true scope of the invention.

What is claimed is:

1. A system for demonstrating acoustic performance to consumers in order to evaluate different speakers, comprising:

a user interface for selecting options for a consumer, including a selected demonstration speaker model from a plurality of available demonstration speaker models;

a series of stored first characteristic samples reflecting the performance of the plurality of demonstration speaker models, wherein the first characteristic samples are empirically derived;

one or more acoustic input samples for processing to an acoustic output;

a processor for processing an acoustic input sample and a first characteristic sample corresponding to a selected demonstration speaker model;

a reference speaker model for outputting an acoustic signal based on the result of the processing;

the processing compensating for the performance characteristic of the reference speaker and the performance characteristic of the selected demonstration speaker so as to mimic the performance of the selected demonstration speaker while avoiding bias from the reference speaker;

wherein the outputted acoustic signal provides an accurate representation of the performance of the selected demonstration speaker model outputting the acoustic input sample to the consumer;

and further wherein the user interface permits the consumer to select a different demonstration speaker for processing to an acoustic output in order to compare performance between selected speaker models.

2. The system of claim 1, wherein the system is located in a reference room in a retail outlet.

3. The system of claim 1, further comprising a monitor for displaying an image of the selected demonstration speaker model.

4. The system of claim 1, further comprising a data output for outpuffing printed data regarding the selected demonstration speaker model.

5. The system of claim 1, wherein the reference speaker model comprises headphones and the selected demonstration speaker model comprises free standing speakers.

6. The system of claim 1, wherein the reference speaker model comprises first headphones and the selected demonstration speaker model comprises second headphones.

7. The system of claim 1, wherein the system enables a single reference speaker model to simulate the performance of multiple demonstration speaker models.

8. The system of claim 1, further comprising a series of stored second characteristic samples reflecting the performance of a plurality of demonstration spaces, and wherein the processor is further adapted to process a second characteristic sample corresponding to a selected demonstration space, and wherein the processed result renders an acoustic signal that simulates the performance of the demonstration speaker model outputting the acoustic input sample in the selected demonstration space.

9. The system of claim 8, wherein the second characteristic samples are empirically derived.

10. The system of claim 8, wherein the second characteristic samples are analytically derived.

11. The system of claim 1, further comprising a series of third characteristic samples comprising absorption data and a series of fourth data comprising geometry data, wherein the third characteristic samples and the fourth data enable a user to create a demonstration space for the simulation.

12. The system of claim 8 or claim 11, wherein the user interface enables a user to select the location of the demonstration speaker model in the demonstration space.

13. The system of claim 8 or claim 11, wherein the demonstration space comprises a room.

14. The system of claim 8 or claim 11, wherein the demonstration space comprises the inside of a vehicle.

15. The system of claim 14, wherein the user interface comprises options for selecting at least one of environmental conditions or operational conditions.

16. The system of claim 15, wherein the selectable conditions comprise at least two of the following: a vehicle make; a vehicle model; speed; RPM; gear; engagement of convertible top or sunroof; engagement of windows; and seating location.

17. A system for demonstrating acoustic performance to consumers in order to evaluate different speakers, comprising:

a user interface for selecting options for a consumer including a selected demonstration speaker out of a plurality of available demonstration speakers;

a series of stored transfer characteristics reflecting representing the performance of the plurality of demonstration speakers, said transfer characteristics being represented in any suitable domain including but not limited to the frequency domain or time domain;

an input for inputting an acoustic sample comprising music or other audio data;

a processor for processing a stored transfer characteristic corresponding to the selected demonstration speaker and the acoustic sample; and reference speakers for outputting an acoustic signal corresponding to the processed result, the processing compensating for the performance characteristic of the reference speaker and the performance characteristic of the selected demonstration speaker so as to mimic the performance of the selected demonstration speaker while avoiding bias from the reference speaker;

wherein the outputted acoustic signal provides an accurate representation of the acoustic performance of the selected demonstration speaker outputting the acoustic sample to the consumer.

18. The system of claim 17, further comprising a monitor for displaying an image of the selected demonstration speaker.

19. The system of claim 17, further comprising a data output for outputting printed data regarding the selected demonstration speaker.

20. The system of claim 17, wherein the reference speakers comprise first headphones and the selected demonstration speaker comprises second headphones.

21. The system of claim 17, wherein the reference speakers comprise headphones and the selected demonstration speaker comprises free standing speakers.

22. The system of claim 17, wherein the input comprises a memory that can be accessed to retrieve the acoustic sample from a plurality of acoustic samples stored therein.

23. The system of claim 17, wherein the input comprises a CD player, a DVD player, or an Internet site.

24. The system of claim 17, wherein the processor is adapted to compensate for the reference speakers, simulate the selected demonstration speaker, and apply the acoustic sample.

25. The system of claim 24, wherein the compensation for the reference speakers comprises inverse filtering.

26. The system of claim 25, wherein the inverse filtering is implemented in the time domain as a convolution based on a impulse response.

27. The system of claim 25, wherein the inverse filtering is implemented in the frequency domain as multiplication based on a transfer function.

28. The system of claim 24, wherein the simulation of the selected demonstration speaker comprises filtering.

29. The system of claim 28, wherein the filtering is implemented in the time domain as a convolution with a impulse response.

30. The system of claim 28, wherein the filtering is implemented in the frequency domain as multiplication by a transfer function.

31. The system of claim 17, wherein the user interface includes an option for selecting a demonstration environment out of a plurality of demonstration environments, and further wherein the processor is adapted to simulate a selected demonstration environment.

32. The system of claim 31, wherein the processor is further adapted to compensate for a reference environment in which the acoustic performance is demonstrated.

33. The system of claim 32, wherein the compensation of the reference environment is performed using inverse filtering.

34. The system of claim 32, wherein the reference environment is a listening room in a retail outlet.

35. The system of claim 17, wherein the user interface includes an option for building a demonstration environment, and further wherein the processor is adapted to simulate the demonstration environment.

36. The system of claim 35, wherein the option for building a demonstration environment includes at least one of selectable absorption characteristics and geometry.

37. A method for simulating acoustic performance to consumers in order to evaluate different speakers, comprising:

(a) accessing a user interface that includes options for selecting a demonstration speaker from a plurality of available demonstration speakers;

(b) selecting a demonstration speaker;

(c) performing one of selecting an environment and building an environment;

(d) performing at least one of (1) selecting an acoustic sample from a plurality of stored acoustic samples available from the user interface and (2) the consumer providing an acoustic sample for input for processing;

(e) listening to the output of the selected demonstration speaker on at least one reference speaker; and (f) repeating at least steps (b) and (e) for a different demonstration speaker so that the user can compare the performance of the demonstration speakers on the same at least one reference speaker;

wherein the output is generated by processing to compensate for the performance characteristic of the reference speaker and the performance characteristic of the selected demonstration speaker so as to mimic the performance of the selected demonstration speaker while avoiding bias from the reference speaker;

wherein the outputted acoustic signal provides an accurate representation of the performance of the selected demonstration speaker model outputting the acoustic sample to the consumer.

38. The method of claim 37, further comprising step of (g) viewing a visual display with an image of the selected demonstration speaker.

39. The method of claim 37, further comprising the step of (g) receiving printed output data regarding the selected demonstration speaker.

40. The method of claim 37, wherein the reference speaker comprises first headphones and the selected demonstration speaker comprises second headphones.

41. The method of claim 37, wherein the reference speaker comprises headphones and the selected demonstration speaker comprises free standing speakers.

42. The method of claim 37, wherein the steps are performed in a listening room in a retail outlet.

43. The method of claim 37, wherein the environment comprises a room or the interior of a vehicle.

44. The method of claim 37, wherein the environment comprises a room and further comprising the step of selecting a location of the demonstration speaker in the room.

45. The method of claim 37, wherein the environment comprises the interior of a vehicle, and further comprising the step of selecting at least one of environmental conditions and operating conditions regarding the vehicle.

46. The method of claim 45, wherein the selectable conditions comprise at least two of the following: a vehicle make; a vehicle model; speed; RPM; gear; engagement of convertible top or sunroof; engagement of windows; and seating location.

47. A method for providing an acoustic simulation to consumers in order to evaluate different speakers, comprising:

accessing a stored reference speaker characteristic data;

utilizing the retrieved reference speaker characteristic data to compensate for the effects of the reference speaker;

accessing stored demonstration speaker characteristics data to retrieve a characteristic for a selected demonstration speaker, there being stored such demonstration speaker data for a plurality of demonstration speakers so that the consumer can compare performance between selected demonstration speakers;

utilizing the retrieved demonstration speaker characteristic data;

accessing stored environmental characteristics data to retrieve a characteristic for a selected environment, there being stored such environmental data for a plurality of environments;

utilizing the retrieved environmental characteristic data;

applying an acoustic sample; and outputting the processed result to the reference speaker for presentation to the consumer;

the output mimicking the performance of the selected demonstration speaker using the reference speaker and providing an accurate representation of the performance of the selected demonstration speaker outputting the acoustic sample to the consumer and avoiding bias from the reference speaker.

48. The method of claim 47, further comprising the step of providing a visual display of an image of the selected demonstration speaker.

49. The method of claim 47, further comprising the step of outputting printed data regarding the selected demonstration system.

50. The method of claim 47, wherein the reference speaker comprises first headphones and the demonstration speaker comprises second headphones.

51. The method of claim 47, wherein the reference speaker comprises headphones and the demonstration speaker comprises free standing speakers.

52. The method of claim 47, further comprising the steps of:

accessing a stored environment characteristic; and utilizing the stored environment characteristic to remove the effects of the reference environment.

53. The method of claim 47, wherein the characteristic for a selected environment is created by user selection from an interface allowing selection of absorption parameters and geometry.

54. The method of claim 47, further comprising the step of retrieving the acoustic sample from a plurality of acoustic samples.

55. The method of claim 47, wherein the acoustic sample is received as an input from a user.

56. The method of claim 55, wherein the user inputs the acoustic sample from a CD or DVD or other acoustic data input.

57. The method of claim 47, further comprising the step of retrieving the acoustic sample from an Internet site.

58. A method for providing a virtual noise simulation to a consumer in order to compare vehicles or operating conditions for a vehicle, comprising:

providing a user interface for selecting options for simulating an acoustic environment for a vehicle, wherein the options enable the user to select from among a plurality of vehicles, and further wherein the options enable to user to select from a plurality of operating conditions for a specific vehicle;

receiving user selections of the options; and providing a virtual noise simulation to the consumer based on the selected options, wherein the virtual noise simulation provides an acoustic output representing the acoustic environment of the specific vehicle while in operation and receiving new user selections changing at least one of the selected vehicle and the selected operating condition;

providing a modified virtual noise simulation to the consumer in order to allow the consumer to compare the different acoustic environments corresponding to the different consumer selections.

59. The method of claim 58, wherein the vehicle comprises a car, boat, or plane.

60. The method of claim 59, wherein the vehicle comprises a car, and wherein the options include at least three four of the following: make, model, engine size or type, speed, RPM, gear, engagement status of sunroof or convertible top, engagement status of windows, and the location of listener.

61. The method of claim 59, wherein the vehicle comprises a boat, and wherein the options include at least four of the following: make, model, engine size or type, speed, RPM, sea state, and location of listener.

62. The method of claim 59, wherein the vehicle comprises a boat, and wherein the options include a two-cycle engine and a four-cycle engine, thereby enabling the user to compare the acoustic performance of the boat equipped with a two-cycle engine to the acoustic performance of the boat equipped with a four-cycle engine.

63. The method of claim 59, wherein the method is practiced at a car dealership in order to allow consumers to compare the acoustic performance of various cars under various operating conditions.

64. The method of claim 59, wherein the method is practiced at a boat dealership in order to allow consumers to compare the acoustic performance of various boats under various operating conditions.

65. The system of claim 1, wherein there is a plurality of acoustic input samples; further wherein:

the user interface permits the consumer to select a specific acoustic input sample from the plurality of acoustic input samples.

66. The system of claim 1, wherein the system is adapted to permit the consumer to input the acoustic input sample for the acoustic demonstration, further comprising:

an input for inputting an acoustic input sample supplied by the consumer to the processor for processing.

67. The system of claim 1, wherein the first characteristic comprises the performance characteristic of the selected demonstration speaker model adjusted by the performance characteristic of the reference speaker model.

68. The system of claim 25, wherein the inverse filtering is implemented as a combination of time domain processing and frequency domain processing operations.

69. The system of claim 28, wherein the filtering is implemented as a combination of time domain processing and frequency domain processing operations.

70. The system of claim 24, wherein the processor implements filtering to simulate the selected demonstration speaker and to compensate for the reference speakers, said filtering being implemented as a combination of time domain processing operations and frequency domain operations.

71. The system of claim 24, wherein the processor implements filtering to simulate the selected demonstration speaker and to compensate for the reference speakers, said filtering being implemented using frequency domain processing operations.

72. The system of claim 24, wherein the processor implements filtering to simulate the selected demonstration speaker and to compensate for the reference speakers, said filtering being implemented using time domain processing operations.

73. The system of claim 17, wherein the input for inputting an acoustic input sample is adapted to permit the consumer to input the acoustic input sample for the acoustic demonstration.

74. A computer-implemented method of implementing a virtual speaker demonstration to consumers in order to evaluate different speakers, comprising:

selecting a plurality of demonstration speakers for demonstration to consumers who can select different demonstration speakers for evaluation;

storing a plurality of response characteristic data corresponding to the plurality of demonstration speakers;

selecting a reference speaker to be used to demonstrate the performance of the demonstration speakers to consumers;

evaluating the response characteristic of the reference speaker to determine compensation for compensating for the response characteristic of the reference speaker;

processing the response characteristic data of a specific demonstration speaker;

processing an acoustic sample;

outputting an acoustic signal to the consumer using the reference speaker to accurately mimic the performance of the specific demonstration speaker while avoiding bias from the reference speaker.

75. The computer-implemented method of claim 74, wherein evaluating the response characteristic of the reference speaker results in a determination of a compensation for accurate demonstration of the demonstration speakers, further comprising:

processing to compensate for the response characteristic of the reference speaker.

76. The computer-implemented method of claim 75, wherein the processing to compensate is implemented using inverse filtering.

77. The computer-implemented method of claim 75, wherein the processing to compensate is implemented by processing in the frequency domain.

78. The computer-implemented method of claim 75, wherein the processing to compensate is implemented by processing in the time domain.

79. The computer-implemented method of claim 74, wherein evaluating the response characteristic of the reference speaker results in a determination that compensation for the reference speaker can be avoided while still providing accurate demonstration of the demonstration speakers.

* * * * *